US005927011A

United States Patent [19]

Sickenius

[11] Patent Number: 5,927,011

[45] Date of Patent: Jul. 27, 1999

[54] CHILD AND PET SAFETY GATE

[76] Inventor: Louis Stephen Sickenius, 2281 Spinnaker Cir., Longmont, Colo. 80503

[21] Appl. No.: 08/769,425

[22] Filed: Dec. 19, 1996

[51] Int. Cl.[6] ..... E06B 7/00

[52] U.S. Cl. ..... 49/56; 49/50; 49/70; 49/104

[58] Field of Search ..... 49/70, 463, 163, 49/168, 194, 195, 196, 98, 104, 50, 56, 57, 55

[56] References Cited

U.S. PATENT DOCUMENTS

| | | | |
|---|---|---|---|
| 168,455 | 10/1875 | Cook et al. . | |
| 1,970,836 | 8/1934 | Benson | 20/36 |
| 4,103,458 | 8/1978 | Booker | 49/56 |
| 4,738,053 | 4/1988 | Biesenthal | 49/70 |
| 4,884,614 | 12/1989 | Spurling | 160/225 |
| 4,891,906 | 1/1990 | Knapp | 49/65 |
| 5,066,079 | 11/1991 | Lawrence | 49/70 X |
| 5,399,008 | 3/1995 | Vann | 49/163 X |
| 5,535,550 | 7/1996 | Yang | 49/163 |

FOREIGN PATENT DOCUMENTS 238215 3/1962 Australia .

*Primary Examiner*—Jerry Redman
*Attorney, Agent, or Firm*—Saul A. Seinberg

[57] ABSTRACT

A self-aligning, simple to use and reliable child/pet safety gate (2) that is removably mounted by a support assembly (4) to an existing room door (12) by hanging the support assembly on the room side doorknob (10) without the use of mounting hardware is disclosed. This design allows the gate to be used or stored while so mounted to the room door. Further, with the gate in its stored, hidden position behind the door, the existing room door can still be opened and closed in a normal fashion. Yet, it is a simple matter to place and secure the gate's blocking assembly (6) in its operative or blocking position by pivoting it to block the open area and then latching it to the door frame using a locking strap (54) and pin (60) and the existing door lock bolt aperture (62) to secure the blocking assembly.

30 Claims, 5 Drawing Sheets

CHILD AND PET SAFETY GATE

BACKGROUND

1. Field of the Invention

This invention relates to safety gates, specifically to safety gates that are adapted to keep children and/or pets in or out of a designated room or area by adapting such gates for easy mounting to, storage on and removal from modern doors and doorway construction.

2. Description of the Prior Art

Safety gates of various designs are currently available for the purpose of keeping children and/or pets confined to a room or "safe" area. Although these gates typically satisfy the requirement of confining a child or pet in a designated area, they can be cumbersome to install and difficult to manage once installed. Further, such installation problems for such prior art safety gates will be exacerbated by nonstandard or poorly fitted or constructed doors and doorways.

The design challenge for these safety devices includes adaptability to a wide range of doorway formats and construction, openness to the designated safe area so that the guardian(s) remain aware of what is transpiring in the designated safe area and the provision of easy passage into and out of the designated safe area by a guardian, all without compromising the basic safety or movement restriction features of such gates. In addition, it is desirable to provide such gates with detachable, movable or temporary mounting capability so that the gates may be quickly and efficiently switched from an operative to an inoperative, non-intrusive mode and back again. These requirements have led to designs in which installation can be complex, cumbersome and/or intrusive resulting in safety gate operation that is inconsistent with and often ineffective for their intended purpose.

One problem that is often encountered by designers and users of safety gates is the wide variety of doorways used in homes, offices and other buildings. In order to compensate for the disadvantages of various doorway designs while attempting to maintain ease of use, various springs, levers, brackets and, in some cases permanent hardware, such as screws, are used to install, secure and support the main gate. Further, because doors and doorways vary in size and construction, it is a problem to insure that safety gates are easily and properly located in a secure manner.

When spring loaded gate supports are used to span the doorway opening, there is a high probability that the gate will become dislodged by the pet or child in the designated safe area applying their weight against the gate or by another child trying to gain entry to the designated safe area. This is due to the false reliance on spring loading and friction being sufficient to hold the gate in place, which cannot be guaranteed at all times. Consider, for example, a newly polished wood door frame or a painted door frame where the oils in the polish or the too smooth painted surfaces will minimize the friction between the spring loaded gate support and the door frame. Other factors such as the care taken in installation by different guardians, product wear and regular installation and removals can all lead to variations in mounting stability, thus exposing the reliability of the gate if pushed against by the child or pet.

Some previously and currently available designs address the instability of spring loaded gates by using permanent mounting hardware such as screws or other securing mechanisms. These designs typically require some level of expertise to install. Tools are usually required for the installation and damage to the door frame (e.g. screw holes) is common. Unfortunately, most of these designs leave the safety gate fully or partially exposed in the doorway or passageway to which they are secured thereby converting such gates to safety hazards when they are not in use. In addition, the exposed securing mechanisms may be subjected to tampering or accidental damage which further limits their effectiveness and trustworthiness.

Potentially, the greatest design challenge is to offer an effective, safe barrier that also allows for ease of passage by the guardian. Some types of gates available today require the guardian to step over or disengage the gate, which can be difficult and potentially dangerous, particularly if one is carrying a child or another object. Other designs require the guardian to retract and/or remove the gate to allow for passage. This is not user friendly and can allow time for a pet or child to escape the designated safe area. Such gates also require the guardian to readjust and resecure the gate.

Swing gates are built into some of the designs which allows for relatively easy passage by the guardian. Here the user is essentially are provided with a gate within a gate, which is usually a considerably more complex and expensive design. In addition, the mounting hardware in these designs span the base of the doorway thus creating a potential trip hazard while simultaneously exposing the mounting hardware to damage that could compromise the effectiveness and operation of the swing gate assembly.

There are also many other types of devices and arrangements that provide limited or restricted access to designated areas and/or serve to insulate or protect designated areas from intrusions by unwanted materials. In most instances, these are security devices or insulating barriers or conduits that are not intended to serve the same purpose of or function as a safety gate, although they may have a limited number of features in common.

One early device for restricting access to a designated area is illustrated in U.S. Pat. No. 168,455, which issued to Cook et al. The Cook et al arrangement provides for a perforated doorjamb in a prison cell so that activity within the cell can be monitored without compromising security of the cell. The perforated jamb is itself provided with a secondary door so that it can be covered when its viewing capability is not required.

Another early device is the insulating door shield described in U.S. Pat. No. 1,970,836 to Benson. The Benson device, intended as an alternative to commonly available storm doors, was removable fastened to a permanent door and pivoted therewith without interfering with the functioning of the permanent door.

An environmental barrier device is shown in U.S. Pat. No. 4,738,053 to Biesenthal This device, called a "Jiffy Jamb", is provided with interior conduits and fits between the open door of a building and its doorjamb movably filling the open space therebetween while permitting hoses, electrical wires, tubing, piping and like carriers to pass through its conduits into the building. This device allows access to and egress from the building while in use yet it seals the open space against loss of heat and intrusion by children, pets or insects when operational. Unfortunately, the "Jiffy Jamb" is cumbersome to mount and limits ordinary use of the doorway in which it is employed.

An interlocking door guard is depicted in U.S. Pat. No. 4,891,906 to Knapp. The Knapp guard is intended to secure a permanent door against unwanted, forced entry. It is a security device that is movably mounted to the permanent door and designed to absorb the stress of forced intrusion without causing the casing or hinges of the permanent door to fail.

U.S. Pat. No. 4,884,614 to Spurling describes an improved safety gate and prior art thereto for preventing the unwanted passage of a child or pet to or from a room. The Spurling gate, which is adapted to be mounted on the sidewalls at the top or bottom of a stairway or on the sidewalls of a door frame features a mounting rail with pivoting means fixed to one sidewall of a stairway or door frame and having pivoting means, a locking post that is fixed to the other a sidewall thereof and a removable, expandable gate frame assembly which includes multiple latching means and a locking bar. The gate frame assembly, once placed on the mounting rail, can be secured to the locking bar to prevent access to a protected stairway or access to or egress from a room, or unlocked and pivoted back and forth across the stairway or open doorway when passage therethrough is not intended to be restricted.

The Spurling gate was intended to overcome the deficiencies of and replace the then popular frictionally engageable gate which expanded into a locked position, but was prone to being pushed over and disengaged. This improvement was achieved at the cost of convenience and of having to permanently secure gate mountings to the door frame where the gate was to be used. This meant that each door frame of every room or area to be secured had to have gate mountings permanently attached thereto.

Australian Patent Number 238,215 to Le Bon et al teaches a child barrier that may be conveniently locked in a releasable closed position when a door with which it is associated is opened or the gate itself is opened when restricted access is no longer desired. In the Le Bon arrangement, one end of the barrier gate is pivotally secured to the door itself near the door hinges and the other end, having a locking pin secured at the top portion therefor is removably clipped in place by its locking pin on the door. When restriction is required, the gate is unclipped and swung toward the door jamb to engage its locking pin in a stop plate fitted into the door jamb sidewall.

One of the major drawbacks of the Le Bon gate is that permanent door mountings have to be used. This will permanently mar the door and this damage will be readily apparent when the time comes to remove the gate. This gate mounting is aesthetically intrusive and can be seen when the door is partially or fully closed. In addition, the door becomes a large lever which, when pushed or leaned against from the front by a large pet or by a child, can pull the locking pin out of engagement and release the gate. In the alternative, pressure applied against the back of the door can jam the locking pin in its stop plate and make the gate difficult to release. Lastly, the hollow interior doors in common use today make the door mountings prone to failure when pressure is applied to the door.

Thus, in one way or another, the prior safety gates all suffered from inherent problems that compromised their ease of use, installation, security, convenience and appearance.

OBJECTS AND ADVANTAGES OF THE INVENTION

It is, therefore, an object of the present invention to provide a self-aligning safety gate in which the gate can be easily, conveniently and safely be moved from an operative to an inoperative or stored position or removed and placed on another door in like fashion without modification of mounting parts or the use of tools.

It is a another object of the present invention to provide a safety gate that is easy to manipulate, a safety gate that can be easily resecured and one which will not, when in an operative or stored position, detract from the appearance of the area in which it will be used.

It is a further object of the present invention to provide a safety gate in which the locking mechanism is secure from tampering by a child or from being dislodged by a pet and yet only minimally intrudes into the doorway or protected space.

It is an additional object of the present invention to provide a safety gate that is adaptable to all standard doorways, that will not damage the door or doorway in which it is used and also permit the full functional use of an existing door and doorway passage without the need to remove the gate from the door.

Accordingly, I have provided a self-aligning safety gate and methods for making such gates that overcome prior art limitations and operational defects. My safety gate is designed to be removably and tool-free mounted and positioned on a door, rather than to the door frame or doorway, as found in prior art versions. This approach cooperatively incorporates portions of the existing door, door hardware and door lock in the overall gate operation, thereby reducing cost while maximizing functionality and ease of utilizations.

These and other objects and advantages of the present invention are accomplished by novel means and methods as shown in the accompany drawings and/or as is described in the following specification.

SUMMARY OF THE INVENTION

Accordingly, there is provided a safety gate for use with a door having a door knob and a lock bolt located therein, the door being mounted in a doorway that includes at least one doorpost having a lock bolt aperture shaped and sized therein to capture the door's lock bolt, the safety gate comprising mounting means for movably coupling said gate to the door knob, blocking means coupled to the mounting means for preventing passage through the doorway when the blocking means is in an operative position and latching means that are movably attached to the blocking means and located at a point thereon from where the latching means can be moved into locking engagement with the lock bolt aperture.

By appropriately and movably locating the latching means on the blocking means, the safety gate can be automatically aligned and positioned on the door. This cooperative range of movement permits the safety gate to be easily transported to and used on a variety of doors. In addition, the latching means are adapted to be mounted at the top or bottom of the blocking means so that either left or right hand doors and doorways can be readily accommodated.

BRIEF DESCRIPTION OF THE DRAWINGS

In the drawings where like reference numerals have been used in the several views to identify like parts and elements of my invention.

DESCRIPTION OF THE PREFERRED EMBODIMENTS

Figure 1:
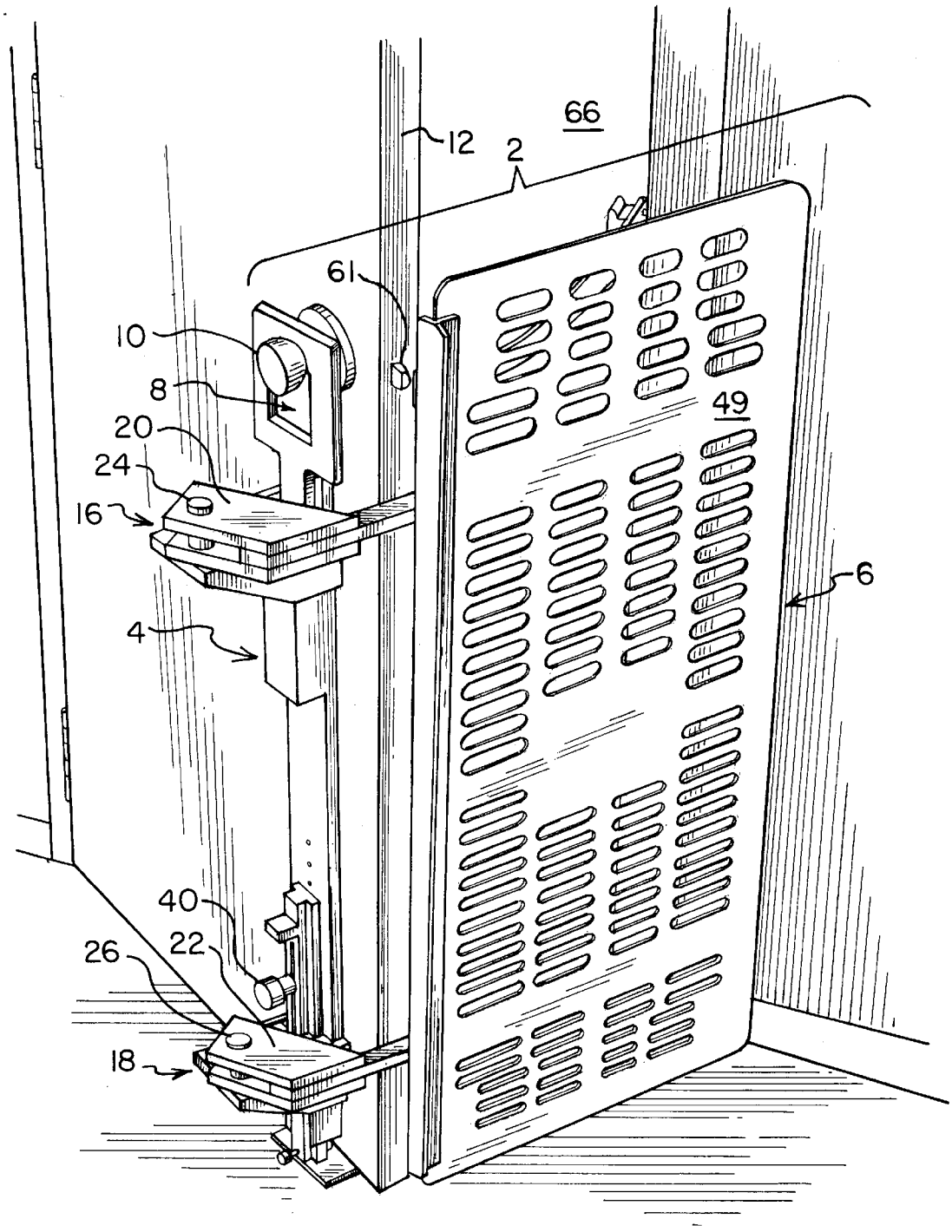
FIG. 1 shows a perspective view as seen from the secured area of a safety gate made and installed in accordance with the present invention.

Referring now to the drawings, FIG. 1 shows a perspective view of a safety gate 2 constructed and made in accordance with the teachings of the present invention, as mounted in use on a door in a typical doorway. The gate 2, consists of two main elements, a support assembly 4 and a blocking assembly 6.

The support assembly 4 includes a locating aperture 8 which is hung over the door knob 10, similarly to how one would slip a "do not disturb" sign over a hotel room door knob, thereby suspending support assembly 4 from the door knob 10. To further secure and correctly locate support assembly 4 on a door 12, locating aperture 8 is provided with a keyed top portion 14 (see FIG. 2) that is shaped to accommodate the shaft of door knob 10 therein. To help protect the surface of the shaft of door knob 10, the interior portion of locating aperture 8 can be lined with felt or similar material (not shown) which is permanently secured thereto; for example, by being glued or stapled thereto.

Figure 2:
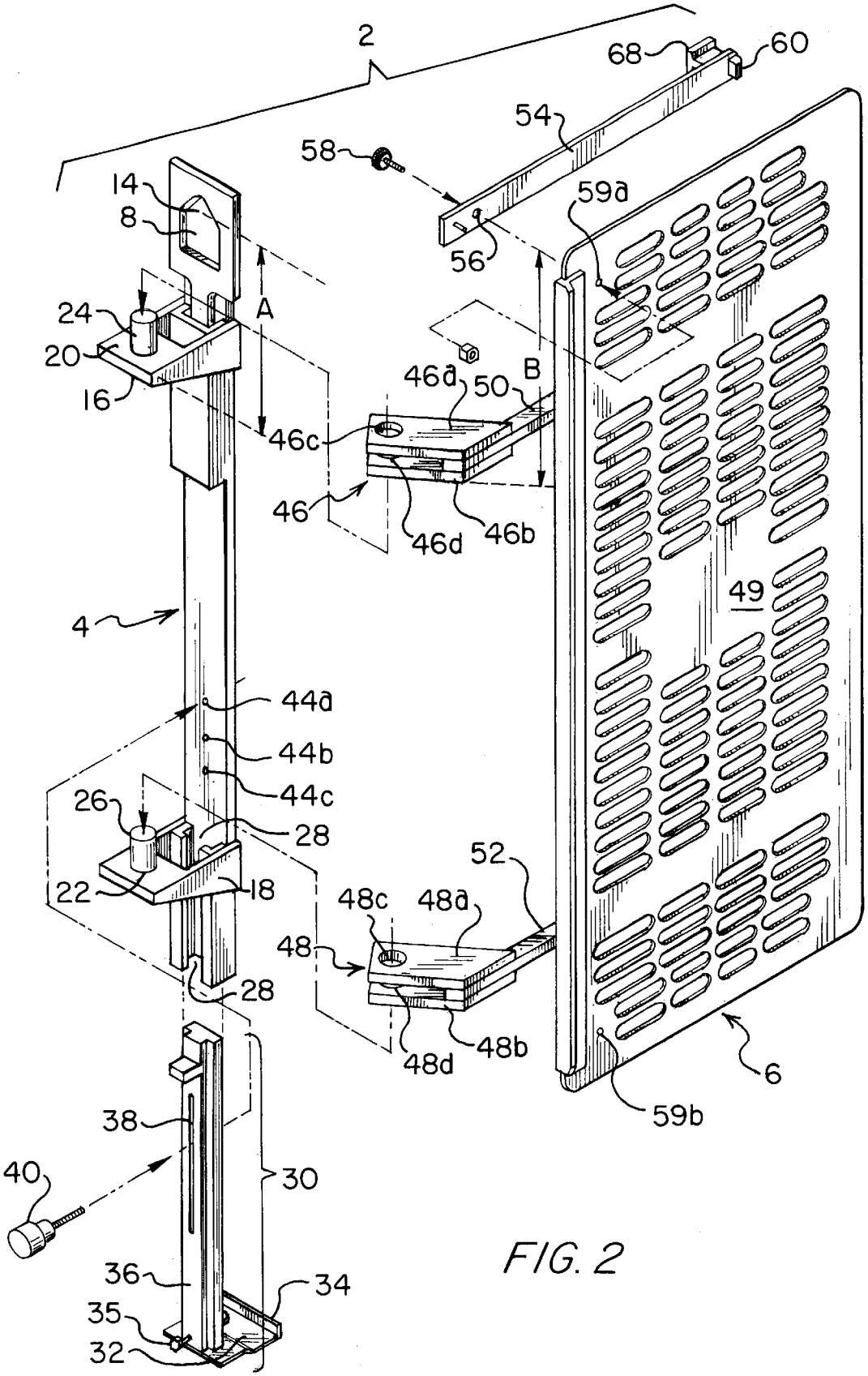
FIG. 2 illustrates an exploded perspective view of the safety gate shown in FIG. 1.

As illustrated in FIGS. 1 and 2, support assembly 4 is further provided with spaced apart top and bottom standoffs 16 and 18, each having a upwardly facing surface 20 and 22 which respectively support pivot pins 24 and 26 mounted thereto. The pivot pins 24 and 26 are placed in generally vertical alignment on support assembly 4 in order to facilitate mounting of blocking assembly 6 thereto.

Also provided is a keyed guide slot 28, that generally runs from the bottom of support assembly 4 to top surface 22 of standoff 18. The length of guide slot 28 isn't critical; it merely needs to be long and strong enough to prevent lateral movement perpendicular to support assembly 4 by a key that will be slidably mounted therein.

The base of support assembly 4 is provided with a clamping assembly 30 that aids in securing support assembly 4 to the door 12. Clamping assembly 30 includes a shoe plate 32, having an upwardly tilted flange 34 at one end thereof, that is intended to slide under the bottom of door 12 and be secured thereto by locking screw 40 as shall hereinafter be described. Locking screw 40, when loosened, permits shoe plate 32 to be moved vertically into and out of secure engagement with the bottom of door 12. Locking screw 35, when tightened against the lower door surface, secures shoe plate 32 against the bottom of door 12. The surface of shoe plate 32 can be lined with felt or similar material (not shown), which is permanently glued or otherwise secured thereto, to protect the bottom of the door against which shoe 32 is clamped.

A vertical, upwardly extending stanchion 36 is mounted to the other end of shoe plate 32. The stanchion 36 is shaped and adapted to be slidingly engaged within guide slot 28 and includes a clamping slot 38 and a clamping screw 40. Clamping screw 40 is provided to fit into clamping slot 38 and engage any one of a series of screw hole 44*a*, 44*b* and 44*c*, three are shown for illustrative convenience in FIG. 2, formed in the rear of support assembly 4. When filly tightened, clamping screw 40 presses stanchion 36 against the rear surface of support assembly 4 thereby preventing stanchion 36 from moving vertically.

The length of clamping slot 38 is appropriately selected so that locking screw 40, even when loosely threaded into one of holes 42*a*, 42*b* or 42*c*, will bump up against the bottom of slot 38 and prevent stanchion 36 from sliding any further upwardly in guide slot 28. Similarly, locking screw 40 will bump against the top of slot 38 and prevent stanchion 36 from being slid any further downwardly in guide slot 38.

By moving and then clamping stanchion 38 so that shoe plate 32 fits snugly under the bottom of door 12 that support assembly 4 is coupled to, support assembly 4 is pulled downwardly while clamping assembly 30 is pulled upwardly and is thereby secured tightly between door knob 10 and the door bottom. Yet, by simply loosening shoe plate 32, the entire gate can then be readily removed from the door knob 10 it is suspended from and relocated on another door in a matter of minutes.

As also shown in FIGS. 1 and 2, blocking assembly 6 is provided with two sets of paired parallel lugs, 46 and 48, respectively. Each set of lugs comprises a pair of pivot braces with concentric apertures that are dimensioned to accommodate the pivot pins 24 and 26. Lug 46 comprises pivot braces 46*a* and 46*b* and lug 48 comprises pivot braces 48*a* and 48*b*. The pivot braces are mounted to blocking plate 49 by means of mounting struts 50 and 52 to which they are respectively joined, parallel to each other, as depicted in FIG. 2. Pivot brace 46*a* is joined to the top of strut 50 and pivot brace 46*b* is mounted to the bottom of strut 50, both at an angle which facilitates a wider swing angle of the blocking assembly 6 as it is pivoted about pivot pins 24 and 26. Similarly, pivot brace 48*a* is joined to the top of strut 52 and pivot brace 48*b* is mounted to the bottom of strut 52, both at the same angle that was used to secure pivot braces 46*a* and 46*b* to strut 50, which also permits the blocking assembly 6 to be similarly pivoted about pivot pins 24 and 26 with the desired pivot range.

Each of the pivot braces 46*a*, 46*b*, 48*a* and 48*b* are provided, respectively, with concentrically aligned, commonly sized pivot pin apertures 46*c*, 46*d*, 48*c* and 48*d*. These pivot pin apertures, respectively, accept pivot pins 24 and 26 when blocking assembly 6 is thereby joined to support assembly 4 by fitting pin 24 filly into pin apertures 46*c* and 46*d* and pin 26 fully into pin apertures 48*c* and 48*d* with locating aperture 8 hung over door knob 10.

A flexible, removable locking strap 54 having a mounting hole 56 at one end thereof is movably secured to the top of blocking plate 49 as shown in FIG. 2 by screw 58 into aperture 59*a*. A similar aperture 59*b* is formed in the bottom of blocking plate 49 as shown in FIG. 2. If a user of gate 2 encounters a doorway and door arrangement which is the opposite of that shown in the drawings, it is a simple matter to rotate blocking assembly 6 one hundred eighty degrees and secure locking strap 54 to blocking assembly 6 through aperture 59*b* at what is now the new top of blocking assembly 6. Thus, both left and right hand hinged doors can be accommodated by simply rotating blocking assembly 6 and moving locking strap 54, as appropriate, from top to bottom or reverse, for use on either right hand or left hand hinged doors.

A locking pin 60 is formed at or joined to the other end of locking strap 54 and faces blocking plate 49. Locking pin 60 is sized to fit as deeply and as relatively snugly as possible into the latch bolt aperture 62, see FIG. 5, formed in the side frame 64 of a typical doorway 66. Ordinarily, latch bolt aperture 62 functions to accept and retain the bolt 61 from a mortise lock, through strike plate 67 which covers the latch bolt aperture 62. A pull knob 68 is mounted to the other side of locking strap 54, opposite locking pin 60, to help maneuver flex locking strap 54 and pull it out of the bolt aperture 62. The flexibility of locking strap 54 is preselected to have the appropriate spring load so that it normally urges locking pin 60 into the bolt aperture 62 and cannot be readily pulled out of aperture 62 by a child from that side of gate assembly 2, yet is completely and easily movable by a parent or guardian with moderate effort.

Figure 3:
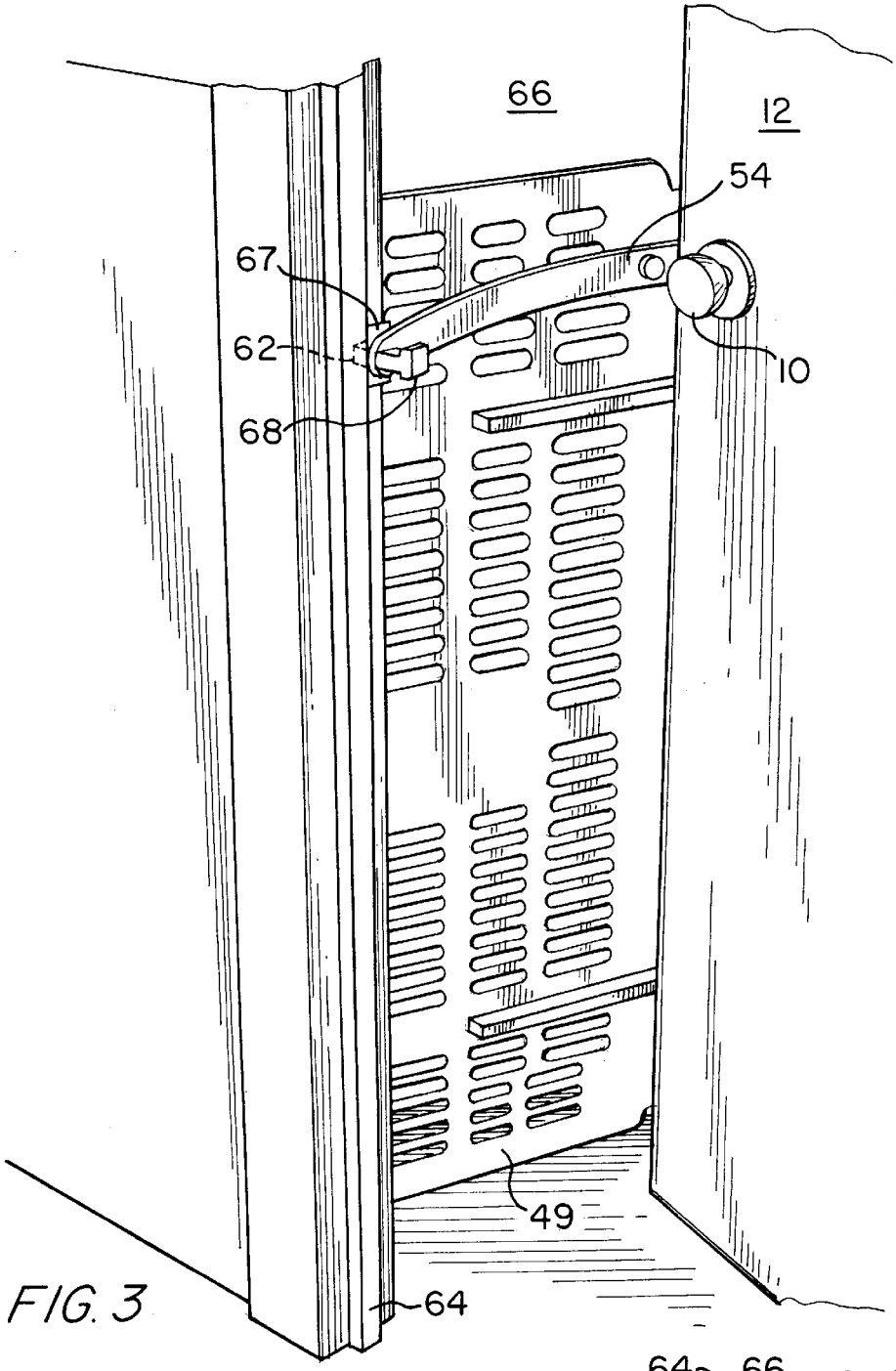
FIG. 3 depicts a perspective view of the safety gate mounted on a door as seen from outside the secured area.

As shown in FIG. 3, locking strap 54 fits snugly into latch bolt aperture 62 formed in the side of the doorway in which safety gate 2 is secured. The door 12 itself stays open, although movement to and from the secured area is restricted by safety gate 2. While in this position, the gate creates a safe child/pet boundary and offers a parent or guardian a view of the safe area that has been created. In that manner, any sound coming from the secured area, such as might be made by a sleeping child or a child at play, can be readily monitored without sacrificing security. To enter the room, a parent or other user only has to pull on knob 68, thereby removing locking pin 60 from bolt aperture 62, and then pivot blocking assembly 6 back behind door 12.

The placement of apertures 59*a* and 59*b* is important and contributes to the self-aligning feature of the present invention. As illustrated in FIG. 2, the distance from the center of aperture 14, which is the center of door knob 10, to the upper surface 20 of top standoff 16, distance A, is made to approximately equal the distance between the center of aperture 59*a* or aperture 59*b*, depending on whether a left or right hand door is being used, and the bottom surface of lower lug 46*b* of the top lug set 46, distance B. Distances A and B also approximate the distance between the horizontal center axis of the lock bolt 61 mounted in the door and the horizontal center axis of the door knob or the distance between the center of the bolt aperture 62 and the center of the door knob 10. Because locking strap 54 is made flexible and also pivotally mounted to blocking assembly 6, it can be moved and/or pivoted to accommodate differences between distances A and B or variations in door hardware location from standard positions. Thus, by keeping distances A and B approximately equal and relying on adjustment of locking strap 54 as needed, small differences between the location of locking pin 60 and latch bolt aperture 62 can be easily accommodated so that locking pin 60 can face and fit into latch bolt aperture squarely and securely.

Figure 5:
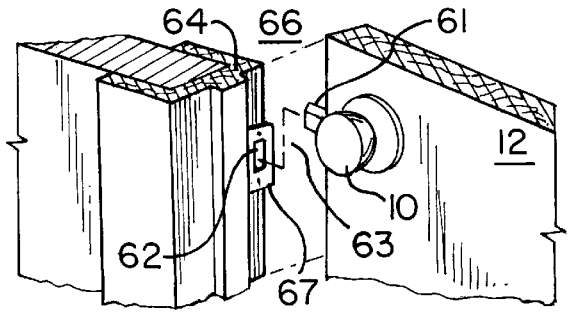
FIG. 5 shows a perspective view of common doorpost arrangement for accepting a door lock bolt as utilized by the latching mechanism of the present invention.

The point at which the locking strap 54 is secured to blocking assembly 6 is effectively determined by the horizontal center axis 63 of lock bolt 61 and lock bolt aperture 62 as shown in FIG. 5. The locking strap 54 is movably secured to blocking assembly 6 at a point which is on or near the horizontal center axis 63 of lock bolt 61 and aperture 62. Variations in the distance between the point or points at which locking strap 54 is secured to blocking assembly 6 can be generally permitted up to the extent of the range of movement permitted locking strap 54. Thus, if locking strap 54 can be moved over a horizontal range of two inches, the point at which locking strap 54 is secured to blocking assembly 6 can be out of horizontal alignment with the horizontal center axis of lock bolt 61 or lock bolt aperture 62 by approximately the same distance. In other words, the point at which locking strap 54 is secured to blocking assembly 6 can be said to place it in general alignment with the horizontal center axis of lock bolt 61 and lock bolt aperture 62 within the range of movement of locking strap 54.

The main portion of blocking assembly 6 is preferably made of plastic material and formed into a plate having slotted or other shaped openings therein, see FIG. 1, so that greater visibility of the area or room secured thereby is achieved. The slots or other openings formed in blocking assembly 6 also permit a child or pet retained in the area secured by gate 2 to see out and retain visual contact with the immediately adjacent area and/or its parent, guardian or owner as the case may be. The thickness of the blocking assembly plate is selected to best provide a tradeoff between size and weight of the plate, the cost of the material used to form the plate and the strength of the plate.

Figure 4A:
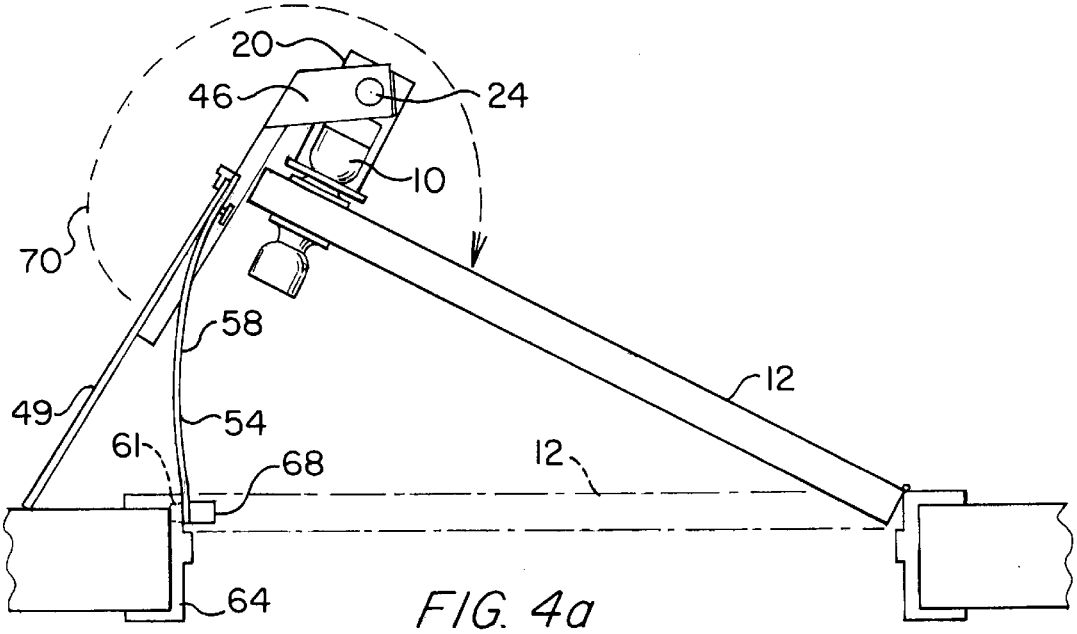
FIG. 4*a* illustrates a top view of the safety gate shown in FIG. 1 in its installed position.

A top view of gate 2 in its installed or operative position is shown in FIG. 4*a*. Pulling on knob 68 moves locking strap 54 away from the doorpost and frees locking pin 60 from aperture 62 as shown by the dashed line position of locking strap 54. This permits blocking assembly 6 to be rotated back around door 12, as shown by the dashed line 70, about pivot pins 24 and 26, thereby permitting entry or egress from the formerly secured area. If desired, upon leaving the secured area, a parent or user only has to pivot the blocking assembly 6 back into its operative position and then resecure it by moving locking strap 54 by means of knob 68 until locking pin 60 once more is engaged in aperture 62.

Figure 4B:
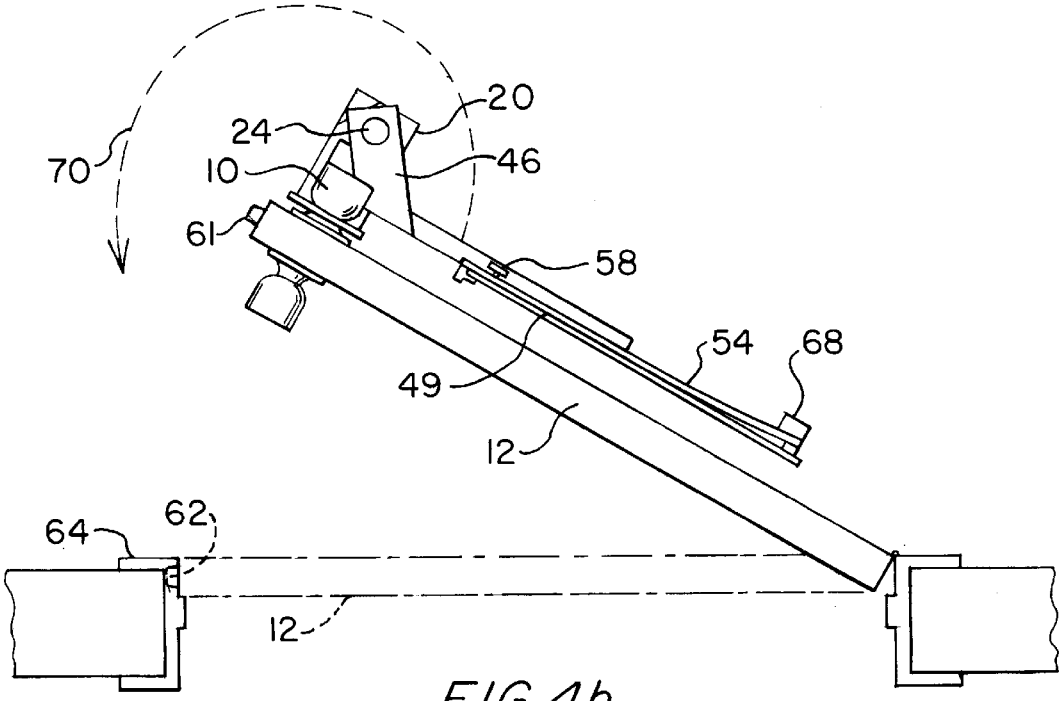
FIG. 4*b* depicts a top view of the safety gate shown in its stored position.
Figure 6:
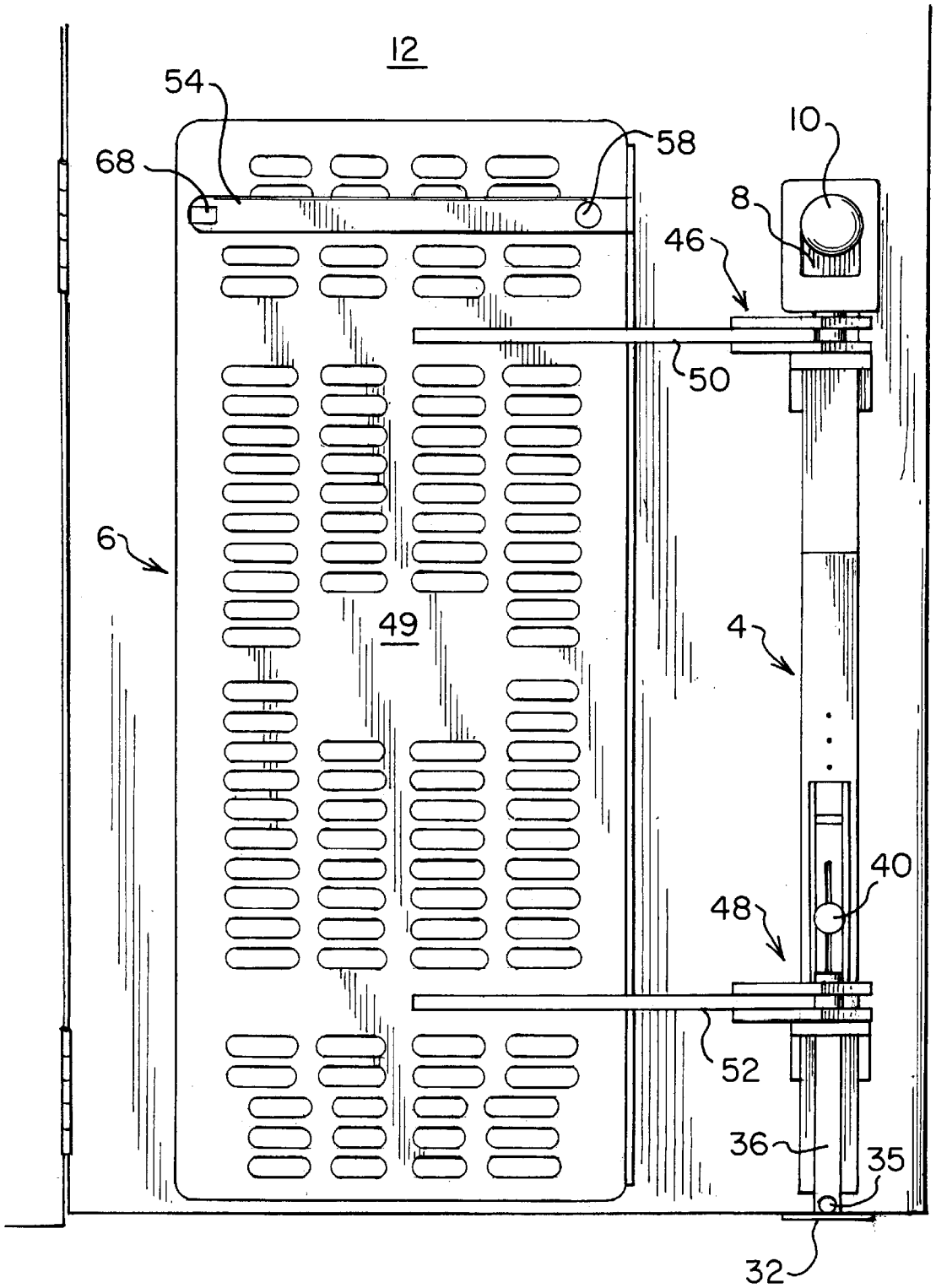
FIG. 6 shows a front view of the safety gate shown in its stored position.

Once blocking assembly 6 is installed onto support assembly 4, blocking assembly 6 can be placed in either its stored position or pivoted into its operative position. To store, blocking assembly 6 is simply pivoted around until flush with the door surface. This is shown in FIG. 4*b* and in FIG. 6. While in its stored position, the room door can function in a normal fashion without any interference from the safety gate 2. The gate can reside in this stored position with the room door 12 in either its open or closed position or at any point in-between. The gate 2 is thus conveniently stored, but ready for use at any time without being generally visible except from inside the room itself. This reduces the impact that gate 2 might otherwise have on the appearance of the area in which it will be used. By releasing shoe plate 32, safety gate 2 can be quickly and easily lifted from door knob 10 and easily placed on another door or simply stored in a closet or other storage area as desired.

Although the description above contains specific arrangements by which the present invention can be realized, these should not be construed as limiting the scope of the invention but as merely providing illustrations of the presently preferred embodiments of this invention. For example, the gate could utilize the top edge of the door for mounting. In addition, hardware such as suction cups and screws could be incorporated into the mounting scheme to aid in securing the safety gate to the door in its stored position. Thus, the embodiment of the present inventions and variations thereof as herein presented are intended to be merely exemplary and those having skill in the appertaining arts will be able to make numerous variations and modifications thereto without departing from the spirit or scope of the present invention. All such variations and modifications are intended to be within the scope of the appended claims.

I claim:

1. A safety gate in combination with a door having a door knob and a lock bolt located therein, the door being mounted in a doorway that includes at least one doorpost having a lock bolt aperture sized, shaped and located therein to capture and secure the lock bolt therein, said safety gate comprising:

a) mounting means for removably coupling at least a portion of said gate to the door knob;

b) blocking means movably coupled with respect to said mounting means for preventing passage through the doorway when moved into an operative position; and c) latching means for securing said blocking means in the doorway, said latching means being movably attached to said blocking means at a point thereon from where it can be moved into locking engagement with the lock bolt aperture.

2. The safety gate according to claim 1 wherein said mounting means includes a top portion having a locating aperture formed therein and wherein said aperture is shaped and adapted to removably accommodate and secure the shaft of the door knob therein.

3. The safety gate according to claim 2 wherein said locating aperture is formed with a keyed neck locating section in the top portion thereof and wherein said keyed section is sized and adapted to removably accommodate and secure the shaft of the door knob therein.

4. The safety gate according to claim 1 wherein said latching means is movably secured to said blocking means at a first location thereon, said first location being in general horizontal alignment with the horizontal center axis of the lock bolt aperture within the range of movement permitted said latching means.

5. The safety gate according to claim 4 wherein said latching means is movably secured to said blocking means at said first location thereon to accommodate a left-handed doorway, said first location being in general horizontal alignment with the horizontal center axis of the lock bolt aperture within the range of movement permitted said latching means when the blocking means is placed in a first orientation or at a second location thereon to accommodate a right-handed doorway, said second location being in general horizontal alignment with the horizontal center axis of the lock bolt aperture within the range of movement permitted said latching means when the blocking means is placed in a second orientation.

6. The safety gate according to claim 5 wherein said mounting means is provided with adjustable clamping means for removably securing said mounting means to the door.

7. The safety gate according to claim 6 wherein said clamping means includes:

a) a vertically movable plate that is adapted to be placed under the door; and b) locking means for securing said plate in place under the door.

8. The safety gate according to claim 2 wherein said latching means is movably secured to said blocking means at a first location thereon, said first location being in general horizontal alignment with the horizontal center axis of the lock bolt aperture within the range of movement permitted said latching means.

9. The safety gate according to claim 8 wherein said mounting means is provided with adjustable clamping means for removably securing said mounting means to the door.

10. The safety gate according to claim 1 wherein said mounting means is formed with a keyed locating section in the top portion thereof and wherein said keyed section is sized and adapted to removably accommodate and secure the shaft of a door knob therein.

11. The safety gate according to claim 10 wherein said latching means is movably secured to said blocking means at a first location thereon, said first location being in general horizontal alignment with the horizontal center axis of the lock bolt aperture within the range of movement permitted said latching means.

12. The safety gate according to claim 11 wherein said latching means is movably secured to said blocking means at said first location thereon to accommodate a left-handed doorway, said first location being in general horizontal alignment with the horizontal center axis of the lock bolt aperture within the range of movement permitted said latching means when the blocking means is placed in a first orientation or at a second location thereon to accommodate a right-handed doorway, said second location being in general horizontal alignment with the horizontal center axis of the lock bolt aperture within the range of movement permitted said latching means when the blocking means is placed in a second orientation.

13. The safety gate according to claim 12 wherein said mounting means is provided with adjustable clamping means for removably securing said mounting means to the door.

14. The safety gate according to claim 13 wherein said clamping means includes:

a) a vertically movable plate that is adapted to be placed under the door; and b) locking means for securing said plate in place under the door.

15. The safety gate according to claim 1 wherein said latching means is movably secured to said blocking means at a first location thereon, said first location being in general horizontal alignment with the horizontal center axis of the lock bolt aperture within the range of movement permitted said latching means.

16. The safety gate according to claim 15 wherein said latching means is movably secured to said blocking means at said first location thereon to accommodate a left-handed doorway, said first location being in general horizontal alignment with the horizontal center axis of the lock bolt aperture within the range of movement permitted said latching means when the blocking means is placed in a first orientation or at a second location thereon to accommodate a right-handed doorway, said second location being in general horizontal alignment with the horizontal center axis of the lock bolt aperture within the range of movement permitted said latching means when the blocking means is placed in a second orientation.

17. The safety gate according to claim 16 wherein said mounting means is provided with adjustable clamping means for removably securing said mounting means to the door.

18. The safety gate according to claim 17 wherein said clamping means includes:

a) a vertically movable plate that is adapted to be placed under the door; and b) locking means for securing said plate in place under the door.

19. The safety gate according to claim 1 wherein said latching means is movably secured to said blocking means at said first location thereon to accommodate a left-handed doorway, said first location being in general horizontal alignment with the horizontal center axis of the lock bolt aperture within the range of movement permitted said latching means when the blocking means is placed in a first orientation or at a second location thereon to accommodate a right-handed doorway, said second location being in general horizontal alignment with the horizontal center axis of the lock bolt aperture within the range of movement permitted said latching means when the blocking means is placed in a second orientation.

20. The safety gate according to claim 19 wherein said mounting means is provided with adjustable clamping means for removably securing said mounting means to the door.

21. The safety gate according to claim 20 wherein said clamping means includes:

a) a vertically movable plate that is adapted to be placed under the door; and b) locking means for securing said plate in place under the door.

22. The safety gate according to claim 1 wherein said mounting means is provided with adjustable clamping means for removably securing said mounting means to the door.

23. The safety gate according to claim 22 wherein said clamping means includes:

a) a vertically movable plate that is adapted to be placed under the door; and b) locking means for securing said plate in place under the door.

24. A safety gate in combination with a door having a door knob and a lock bolt located therein, the door being mounted in a doorway that includes at least one doorpost having a lock bolt aperture sized, shaped and located therein to capture and secure the lock bolt therein, said safety gate comprising:

a) a support assembly adapted to be hung on the door knob for removably coupling at least a portion of said gate thereto;

b) a blocking assembly adapted to be pivotally mounted with respect to said support assembly for preventing passage through the doorway when said blocking assembly is pivoted into its operative position and for storage behind the door when said blocking assembly is pivoted into its storage position; and c) latching means movably attached to said blocking assembly at a point thereon from where said latching means can be moved into locking engagement with the lock bolt aperture.

25. The safety gate according to claim 24 wherein said support assembly includes a top portion having a locating aperture formed therein and wherein said aperture is shaped and adapted to removably accommodate and secure the shaft of the door knob therein.

26. The safety gate according to claim 25 wherein said locating aperture is formed with a keyed locating section in the top portion thereof and wherein said keyed section is sized and adapted to removably accommodate and secure the shaft of the door knob therein.

27. The safety gate according to claim 26 wherein said latching means is movably secured to said blocking assembly at a first location thereon, said first location being in general horizontal alignment with the horizontal center axis of the lock bolt aperture within the range of movement permitted said latching means.

28. The safety gate according to claim 27 wherein said latching means is movably secured to said blocking assembly at said first location thereon to accommodate a left-handed doorway, said first location being in general horizontal alignment with the horizontal center axis of the lock bolt aperture within the range of movement permitted said latching means when said blocking assembly is placed in a first orientation or at a second location thereon to accommodate a right-handed doorway, said second location being in general horizontal alignment with the horizontal center axis of the lock bolt aperture within the range of movement permitted said latching means when said blocking assembly is placed in a second orientation.

29. The safety gate according to claim 28 wherein said support assembly is provided with adjustable clamping means for removably securing said support assembly to the door.

30. The safety gate according to claim 29 wherein said clamping means includes:

a) a vertically movable plate that is adapted to be placed under the door; and b) locking means for securing said plate in place under the door.

* * * * *